US009050637B2

(12) United States Patent
Felkl

(10) Patent No.: US 9,050,637 B2
(45) Date of Patent: Jun. 9, 2015

(54) OPERATING METHOD FOR INTRODUCING A PRODUCT TO BE ROLLED INTO A ROLL STAND OF A ROLL MILL, CONTROL DEVICE, DATA CARRIER, AND ROLL MILL FOR ROLLING A STRIP-TYPE PRODUCT TO BE ROLLED

(75) Inventor: Hans-Joachim Felkl, Forchheim (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 714 days.

(21) Appl. No.: 12/682,693

(22) PCT Filed: Sep. 5, 2008

(86) PCT No.: PCT/EP2008/061746

§ 371 (c)(1),
(2), (4) Date: Apr. 12, 2010

(87) PCT Pub. No.: WO2009/049964

PCT Pub. Date: Apr. 23, 2009

(65) Prior Publication Data

US 2010/0218576 A1 Sep. 2, 2010

(30) Foreign Application Priority Data

Oct. 12, 2007 (DE) ..... 10 2007 049 062

(51) Int. Cl.
*B21B 37/46* (2006.01)

(52) U.S. Cl.
CPC ..... *B21B 37/46* (2013.01); *B21B 2273/06* (2013.01); *B21B 2265/02* (2013.01); *B21B 2271/02* (2013.01); *B21B 2275/04* (2013.01); *B21B 2275/06* (2013.01)

(58) Field of Classification Search
CPC ..... B21B 37/16–37/26; B21B 37/46; B21B 2261/04; B21B 2265/02–2265/04; B21B 2265/08; B21B 2273/06–2273/10; B21B 2273/14; B21B 2271/02
USPC ..... 72/10.3, 8.6, 8, 6.2
See application file for complete search history.

(56) References Cited

U.S. PATENT DOCUMENTS 3,553,997 A * 1/1971 Schoffmann ..... 72/226
4,307,595 A 12/1981 Nishikubo et al. ..... 72/234

(Continued)

FOREIGN PATENT DOCUMENTS

CA 1086105 A1 9/1980 ..... B21B 1/18
DE 1284922 A 12/1968 ..... B21B 37/52

(Continued)

OTHER PUBLICATIONS

Stahl und Eisen 97 (1977) Nr. 9 "Concept of the Automatic Control Systems of an Up-to-Date Cold Strip Tandem Mill According to the Principle of the Rigid Speed Control" (3 pages), 2009.

(Continued)

*Primary Examiner* — Shelley Self
*Assistant Examiner* — Matthew G Katcoff
(74) *Attorney, Agent, or Firm* — King & Spalding L.L.P.

(57) ABSTRACT

A roll mill for rolling a product has a roll stand with working rolls and a control device. The product has a head part and is moved towards the stand at a product head part speed. The working rolls form a rolling gap. The control device controls the stand such that, before the product head part enters the gap, the rolls are rotated at a peripheral speed which is essentially the same as the product head part speed; the gap is vertically adjusted to essentially a product head part thickness, on the feeding side, before the product enters the gap; and, during or following the insertion of the product into the gap, the gap is closed to a pre-determined value, and the peripheral speed of the working rolls is modified, especially increased, according to the gap, essentially at the same time as the closing of the gap.

10 Claims, 3 Drawing Sheets

(56) References Cited

U.S. PATENT DOCUMENTS

| | | | | |
|---|---|---|---|---|
| 4,656,855 | A * | 4/1987 | Sakamaki et al. | 72/10.3 |
| 5,404,738 | A * | 4/1995 | Sekiguchi | 72/11.4 |
| 5,520,037 | A | 5/1996 | Sorgel | 72/8.4 |
| 6,014,882 | A * | 1/2000 | Berger et al. | 72/229 |
| 6,227,021 | B1 * | 5/2001 | Imanari | 72/12.3 |
| 6,311,532 | B1 * | 11/2001 | Ballheimer et al. | 72/10.3 |
| 2008/0223100 | A1 | 9/2008 | Verloop et al. | 72/205 |
| 2009/0235707 | A1 | 9/2009 | Schmidt | 72/11.1 |
| 2009/0306810 | A1 | 12/2009 | Koh et al. | 700/148 |
| 2010/0218576 | A1 | 9/2010 | Felkl | 72/6.2 |

FOREIGN PATENT DOCUMENTS

| | | | | |
|---|---|---|---|---|
| DE | 2823071 | A1 | 11/1978 | B21B 1/18 |
| DE | 2541071 | A1 | 7/1984 | B21B 37/06 |
| DE | 3317635 | | 11/1984 | B21B 1/18 |
| DE | 4352074 | A1 | 5/1994 | B21B 37/52 |
| EP | 0102013 | | 3/1984 | B21B 1/22 |
| EP | 0616559 | B1 | 9/1995 | B21B 37/00 |
| GB | 1543622 | A | 9/1976 | G05D 15/00 |
| JP | 59118212 | | 7/1984 | B21B 37/00 |
| JP | 60037201 | A | 2/1985 | B21B 1/22 |
| JP | 2008000788 | | 1/2008 | B21B 37/12 |
| RU | 2075358 | C1 | 3/1997 | B21B 37/00 |
| WO | 2006119998 | | 11/2006 | B21B 37/26 |
| WO | 2007/104616 | A1 | 9/2007 | B21B 37/26 |
| WO | 2007104604 | | 9/2007 | B21B 37/00 |
| WO | 2009/049964 | A1 | 4/2009 | B21B 37/46 |

OTHER PUBLICATIONS

International Search Report and Written Opinion for Application No. PCT/EP2008/061746 (12 pages), Nov. 18, 2008.

* cited by examiner

OPERATING METHOD FOR INTRODUCING A PRODUCT TO BE ROLLED INTO A ROLL STAND OF A ROLL MILL, CONTROL DEVICE, DATA CARRIER, AND ROLL MILL FOR ROLLING A STRIP-TYPE PRODUCT TO BE ROLLED

CROSS-REFERENCE TO RELATED APPLICATIONS

This application is a U.S. National Stage Application of International Application No. PCT/EP2008/061746 filed Sep. 5, 2008, which designates the United States of America, and claims priority to German Application No. 10 2007 049 062.5 filed Oct. 12, 2007, the contents of which are hereby incorporated by reference in their entirety.

TECHNICAL FIELD

The invention relates to an operating method for introducing a rolling stock, especially a metal strip, into a roll stand of a rolling mill. Furthermore, the invention relates to a control device for a rolling mill, a data carrier and a rolling mill for rolling a rolling stock, especially a metal strip.

BACKGROUND

In the manufacture of semifinished products, a strand or slabs is/are generally cast from liquid rolling stock and subsequently processed further to form the semifinished product. For this purpose, they are generally processed by a hot and/or cold rolling mill.

When rolling stock is introduced or threaded into a roll stand, there are often signs of wear on the working rolls of the roll stand and/or losses in throughput as result of the threading operation. The effects of wear on the working rolls are brought about by the rolling stock that is running into the roll stand hitting the lateral surface of a working roll and causing so-called "roll marks". Depending on the dimensions of such damage to the working rolls, an immediate roll change may be required and this constitutes a high degree of roll wear.

Nowadays various methods are used in rolling mills for threading a rolling stock into a roll stand or into a rolling train in order to avoid such damage to the working rolls.

For example, it is known from the operator side to thread a rolling stock into a rolling train in such a way that at first all the roll stands of the rolling train are open, a rolling stock is introduced into the entire rolling train, subsequently all the roll stands are closed, and then a rolling operation, preferably a continuous rolling operation, is commenced. This has the consequence that a large amount of rejected rolling stock is created with each threading operation. One instance of rejected rolling stock in such a case is the length of the entire rolling train for each threading operation. In particular in the case of discontinuous rolling, i.e. in the case of so-called batch mills, the reduction in efficiency of the rolling train as result of such a threading operation is considerable, since there are rolling stock losses for each slab. Furthermore, this method is time-consuming, since it is carried out manually.

Alternatively, it is likewise known from the operator side to thread a rolling stock into a roll stand with the roll stand already set to a roll gap that provides the reduced thickness of the rolling stock on the outlet side. Here, the rolling stock is introduced into the roll stand very slowly, in order to keep the damage to the working rolls as low as possible. Furthermore, the circumferential speed of the working rolls is much greater than the speed of the rolling stock running in. This is so because the circumferential speed of the working rolls has already been adapted to the outlet thickness of the rolling stock from the roll stand. On the one hand, the damage to the working rolls cannot be entirely avoided here and, on the other hand, the required low speed of the rolling stock on the inlet side leads to losses in throughput.

Also known as a further measure for reducing working roll damage during introduction into a roll stand are special operating modes such as nosing and the application of lubricant, especially oil or an oil emulsion, to the rolling stock. These special operating modes likewise have an adverse effect on a throughput-optimized operating sequence and therefore similarly leads to losses in throughput.

SUMMARY

According to various embodiments, an operating method and a rolling mill can be provided with which the service life of the working rolls and the productivity of the rolling mill are increased.

According to an embodiment, in an operating method for introducing a rolling stock, especially a metal strip, into a roll stand of a rolling mill, the rolling mill has a roll stand with working rolls and a control device, the rolling stock has a head and is moved toward the roll stand at a rolling stock head speed, the working rolls form a rolling gap, the control device activates the roll stand in such a way that, before the head of the rolling stock enters the rolling gap, the working rolls are rotated at a circumferential speed that is essentially equal to the rolling stock head speed, that, before the head of the rolling stock enters the rolling gap, the rolling gap is set in the vertical direction essentially to a thickness of the head of the rolling stock on the inlet side, and that, when or after the head of the rolling stock enters the rolling gap, the latter is closed to a predetermined value and, essentially at the same time as the closing of the rolling gap, the circumferential speed of the working rolls is changed, in particular increased, in dependence on the rolling gap.

According to a further embodiment, a tensile stress of the rolling stock may be measured on the inlet side and/or outlet side upstream and/or downstream of the roll stand, the control device activating adjusting means for influencing the tensile stress of the rolling stock in such a way that an intended tensile stress of the rolling stock in dependence on the measured tensile stress. According to a further embodiment, the control device may activate adjusting means for influencing a tensile stress of the rolling stock in such a way that a tensile stress intended for the rolling stock is maintained by means of manipulated variables pre-calculated by a rolling model.

According to another embodiment, a control device for a rolling mill has a machine-readable program code, which comprises control commands which make the control device carry out the operating method as described above.

According to another embodiment, a data carrier with a machine-readable program code stored on it may carry out the operating method as described above when the program code is executed by a control device for a rolling mill.

According to yet another embodiment, a rolling mill for rolling a rolling stock, especially a metal strip, may have a roll stand with working rolls and a control device, wherein the rolling stock has a head and can be moved toward the roll stand at a rolling stock head speed, wherein the working rolls form a rolling gap, wherein the roll stand can be activated by the control device in such a way that, before the head of the rolling stock enters the rolling gap, the working rolls are rotated at a circumferential speed that is essentially equal to the rolling stock head speed, that, before the head of the rolling stock enters the rolling gap, the rolling gap is set in the vertical direction essentially to a thickness of the head of the rolling stock on the inlet side, and that, when or after the head of the rolling stock enters the rolling gap, the latter is closed to a predetermined value and, essentially at the same time as the closing of the rolling gap, the circumferential speed of the working rolls is changed, in particular increased, in dependence on the rolling gap.

According to a further embodiment of the rolling mill, the tensile stress of the rolling stock can be measured on the inlet side and/or outlet side upstream and/or downstream of the roll stand by means of a device for measuring the tensile stress, adjusting means for influencing the tensile stress of the rolling stock being activated by the control device in such a way that an intended tensile stress of the rolling stock is set in dependence on the measured tensile stress. According to a further embodiment of the rolling mill, adjusting means for influencing the tension of the rolling stock can be activated by the control device in such a way that a tensile stress intended for the rolling stock is maintained by means of manipulated variables pre-calculated by a rolling model.

BRIEF DESCRIPTION OF THE DRAWINGS

Further advantages of the invention emerge from the following exemplary embodiment, which is explained in more detail on the basis of schematic drawings, in which.

DETAILED DESCRIPTION

Figure 1:
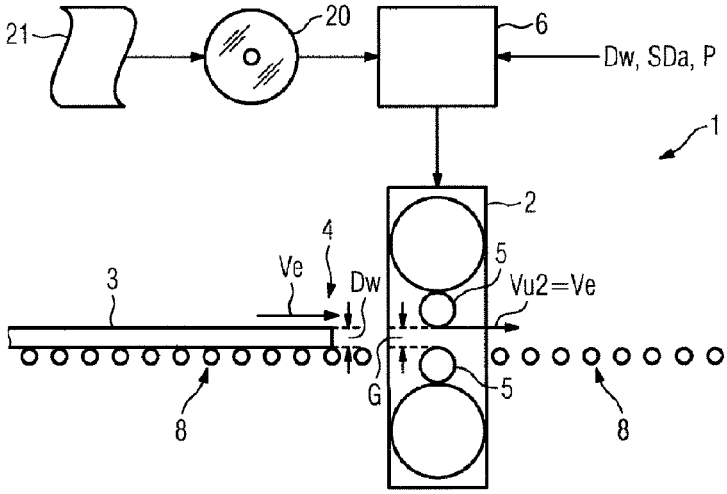
FIG. 1 shows a schematic view of a detail of a rolling mill with a strip running to a roll stand.

According to various embodiments, in an operating method for introducing a rolling stock, especially a metal strip, into a roll stand of a rolling mill, the rolling mill has a roll stand with working rolls and a control device, the rolling stock has a head and is moved toward the roll stand at a rolling stock head speed, the working rolls form a rolling gap, and the control device activates the roll stand in such a way that, before the head of the rolling stock enters the rolling gap, the working rolls are rotated at a circumferential speed that is essentially equal to the rolling stock head speed, that, before the head of the rolling stock enters the rolling gap, the rolling gap is set in the vertical direction essentially to a thickness of the head of the rolling stock on the inlet side, and that, when or after the head of the rolling stock enters the rolling gap, the latter is closed to a predetermined value and, essentially at the same time as the closing of the rolling gap, the circumferential speed of the working rolls is changed, in particular increased, in dependence on the closing state of the rolling gap.

The various embodiments may be used both for single-stand rolling mills and for multi-stand rolling mills. In other words, the rolling mill comprises at least one roll stand. The various embodiments can equally be used for cold rolling trains and hot rolling trains.

The operating method according to various embodiments allows damage to working rolls during the threading of the rolling stock into a roll stand to be avoided virtually completely. Furthermore, the rejected rolling stock is significantly reduced in comparison with the known methods. In addition, the method may be provided for conventional rolling speeds, i.e. there is no need for a special operating mode that leads to losses in throughput for time reasons. Consequently, the productivity of a rolling mill can be increased significantly.

A rolling gap is formed by the working roll lateral surfaces of two working rolls, the vertical extent of the rolling gap being defined by a shortest distance between the upper working roll and the lower working roll through a normal to the lateral surface. The rolling gap may have different vertical extents in the direction of the width of the rolling stock, caused for example by roll crowning, roll wear, thermal expansion of the rolls or roll bending.

The head of the rolling stock, strip head or beginning of the strip is the term used to refer to the end of a rolling stock or strip running into a roll stand that is closest to the roll stand, whereas the foot of the rolling stock or foot of the strip, also referred to as the end of the strip, is the term used to refer to the end of a rolling stock or strip running into a roll stand that is furthest away from the roll stand.

The rolling stock head speed may be recorded, for example, by means of speed sensors. The control device controls the circumferential speed of the working rolls in such a way that the circumferential speed of the working rolls is essentially made to match the rolling stock head speed at the time of entry of the head of the rolling stock into the rolling gap. This avoids a great difference between the circumferential speed and the rolling stock head speed between the working roll lateral surface and the rolling stock or head of the rolling stock, i.e. a high relative speed between the rolling stock and the working roll lateral surface, which could lead to the working roll being damaged. Circumferential speed is understood as meaning the velocity in trajectory of a fixed point on a working roll lateral surface, which essentially describes a circular path as a result of the rotation of the working roll.

Likewise, essentially before the head of the rolling stock enters the rolling gap, the working gap is set essentially to the thickness of the head of the rolling stock running in. On the one hand, this has the effect that the working rolls are not subjected to the risk of being damaged by rolling stock to be introduced into the rolling gap, especially the edges thereof. On the other hand, the roll stroke for closing the rolling gap is as small as possible. The rolling gap is therefore set approximately to the thickness of the head of the rolling stock running in. The rolling gap may be somewhat less or somewhat greater than the thickness of the head of the rolling stock. Preferably, the rolling gap is open somewhat wider than the thickness of the head of the rolling stock running in. The positional determination of the head of the rolling stock takes place, for example, by means of tracking the head of the rolling stock or tracking the rolling stock, which uses reference points and a rolling stock head speed or rolling stock speed that is known for example from rolls or drivers to determine the position of the head of the rolling stock.

Alternatively, though with the risk of damage to the working rolls, it is possible to set the rolling gap to be somewhat less than the thickness of the head of the rolling stock. When the rolling stock reaches the rolling gap, the latter springs open slightly, since the rolling stock is thicker than the rolling gap is high. The springing open of the rolling gap when the head of the rolling stock enters the rolling gap can be advantageously used as a starting signal for increasing the rolling force or applying a load to the rolling gap. Tracking of the rolling stock is consequently not absolutely necessary here to establish the time of entry into the rolling gap. As a result, the loss of rolling stock for the end product can possibly be further reduced.

Essentially during or after the head of the rolling stock has entered the rolling gap, the rolling gap is closed to a predetermined value and, essentially at the same time as or in synchrony with the closing of the rolling gap, the circumferential speed of the working rolls is changed, in particular increased, in dependence on the rolling gap, i.e. the opening of the rolling gap. The rolling gap or rolling gap opening is the term used to refer to the rolling gap setting defining the outlet thickness of the rolling stock. Another way of saying this is that the rolling gap is closed to a predetermined value and, essentially at the same time as the closing of the rolling gap, the circumferential speed of the working rolls is changed, in particular increased, in relation to the running-in speed of the rolling stock, in dependence on the thickness of the rolling stock on the outlet side. In particular, the circumferential speed of the working rolls is changed in dependence on the rolling gap to a circumferential speed defined by the predetermined value of the rolling gap.

The circumferential speed is in this case changed in accordance with the laws of mass flow or laws of volume conservation that apply during rolling in such a way that, essentially when the desired thickness of the rolling stock on the outlet side is reached, the circumferential speed of the working roll lateral surfaces is adapted to the thickness of the rolling stock on the outlet side in conformity with the above laws.

During the synchronous changing of the circumferential speed and the rolling gap by increasing the rolling force to the values prescribed by the desired thickness of the rolling stock on the outlet side, there is generally a non-linear relationship between the changing of the rolling force and the changing of the circumferential speed of the working roll lateral surfaces.

The desired thickness of the rolling stock on the outlet side or the opening of the desired rolling gap may be suitably chosen manually, for example by the operator of the rolling train, or be calculated and prescribed by a rolling model.

According to a further embodiment, a tensile stress of the rolling stock is measured on the inlet side and/or outlet side upstream and/or downstream of the roll stand, the control device activating adjusting means for influencing the tensile stress of the rolling stock in such a way that an intended tensile stress of the rolling stock is set in dependence on the measured tensile stress. This eliminates tensile defects of the rolling stock that could arise when the rolling stock is introduced into at least one roll stand. A roll stand may be regarded as adjusting means for influencing the tensile stress of the rolling stock, or else a roller provided for setting the tensile stress of the rolling stock. For a multi-stand rolling train it is advantageous in particular if the rolling mill has a first roll stand and a second roll stand, arranged downstream of the first, into which the rolling stock is introduced one after the other, a device for measuring a tension of the rolling stock being provided between the first and second roll stands and, when and/or after the rolling stock enters the rolling gap of the second roll stand, the control device activating the first and/or second roll stand in such a way that an intended tensile stress for the rolling stock is set.

According to a further embodiment, the control device activates adjusting means for influencing a tensile stress of the rolling stock in such a way that a tensile stress intended for the rolling stock is maintained by means of manipulated variables pre-calculated by a rolling model. Pre-calculation allows a tensile stress defect of the rolling stock to be detected already before it happens, and allows the adjusting means to be activated by the control device in such a way that a tensile defect for the rolling stock does not occur, but instead an intended tensile stress for the rolling stock is maintained. In particular, it is advantageous that, by means of manipulated variables pre-calculated by a rolling model, the control device activates the first and/or second roll stand in such a way that a deviation of a tensile stress of a rolling stock from an intended tensile stress for the rolling stock is avoided.

The object is achieved in a corresponding way by a control device for a rolling mill which has a machine-readable program code, which comprises control commands which make the control device carry out the operating method as described above.

Various embodiments also extend to a data carrier with a machine-readable program code stored on it for carrying out the operating method as described above when the program code is executed by a control device for a rolling mill.

The part of the object relating to the apparatus is achieved by a rolling mill for rolling a rolling stock, especially a metal strip, wherein the rolling mill has a roll stand with working rolls and a control device, wherein the rolling stock has a head and can be moved toward the roll stand at a rolling stock head speed, wherein the working rolls form a rolling gap, wherein the roll stand can be activated by the control device in such a way that, before the head of the rolling stock enters the rolling gap, the working rolls are rotated at a circumferential speed that is essentially equal to the rolling stock head speed, that, before the head of the rolling stock enters the rolling gap, the rolling gap is set in the vertical direction essentially to a thickness of the head of the rolling stock on the inlet side, and that, when or after the head of the rolling stock enters the rolling gap, the latter is closed to a predetermined value and, essentially at the same time as the closing of the rolling gap, the circumferential speed of the working rolls is changed, in particular increased, in dependence on the rolling gap. Such a rolling mill has the effect of extending the lifetime of the working rolls and increasing the productivity of the rolling mill.

According to a further embodiment of the rolling mill, the tensile stress of the rolling stock can be measured on the inlet side and/or outlet side upstream and/or downstream of the roll stand by means of a device for measuring the tensile stress, adjusting means for influencing the tensile stress of the rolling stock being activated by the control device in such a way that an intended tensile stress of the rolling stock is set in dependence on the measured tensile stress. This makes it possible to eliminate tensile defects in the tensile stress of the rolling stock. For a multi-stand rolling train it is advantageous in particular if the rolling mill has a first roll stand and a second roll stand, arranged downstream of the first, into which the rolling stock can be introduced one after the other, a device for measuring a tension of the rolling stock being provided between the first and second roll stands and it being possible, when and/or after the rolling stock enters the rolling gap of the second roll stand, for the first and/or second roll stand to be activated by means of the control device in such a way that an intended tensile stress for the rolling stock is set.

According to a further embodiment, adjusting means for influencing the tension of the rolling stock can be activated by the control device in such a way that a tensile stress intended for the rolling stock is maintained by means of manipulated variables pre-calculated by a rolling model. The use of pre-calculated manipulated variables allows tensile defects that can be expected for the rolling stock but have not yet occurred to be handled and the tensile stress to be corrected by means of the adjusting means already before the tensile defect occurs in such a way that a tensile defect does not occur or only in a reduced form.

FIG. 1 shows a schematic view of a rolling mill 1 with a rolling stock transporting device 8 and a roll stand 2. The roll stand 2 has a set of working rolls 5 and a set of backing rolls (not designated). A control device 6 is operatively connected to the roll stand 2, so that it can control the function of the roll stand 2.

For carrying out a method according to various embodiments for introducing rolling stock, here metal strip 3, into a roll stand 2 of a rolling mill 1, a machine-readable program code 21 schematically represented in FIG. 1 for automatically carrying out a method is stored in the control device 6.

The program code 21 may be stored in a control device 6 permanently or temporarily. For example—as in FIG. 1—the machine-readable program code 21 is provided once or more than once by means of a data carrier 20 of the control device 6. After feeding the machine-readable program code 21 to the control device 6, the control device 6 can carry out the method according to various embodiments for introducing a metal strip 3 into a roll stand 2 when the machine-readable program code 21 is executed.

FIG. 1 also shows a rolling stock transporting device 8 on the inlet side and on the outlet side, respectively upstream and downstream of the roll stand 2. Arranged on the rolling stock transporting device 8 on the inlet side is a metal strip 3 with a head 4 which has a thickness Dw. The metal strip 3 or the head of the strip 4 moves toward the roll stand 2 at a strip head speed Ve. In FIG. 1, the metal strip 3 has not yet reached a rolling gap G formed by the working rolls 5, i.e. it is only at a point before it enters the rolling gap G.

The control device 6 is fed the strip head thickness Dw, which has for example been determined from a strip thickness measurement, and the strip head speed Ve, which has for example been recorded by means of speed sensors. Furthermore, the control device 6 is fed the desired outlet-side thickness SDa of the metal strip 3. The desired outlet-side thickness SDa of the metal strip 3 may, for example, be calculated by a rolling model or suitably chosen. In addition, the control device 6 is fed further rolling parameters A that are of significance for the manufacture of a desired end product under the given rolling conditions.

In order to make it possible for the metal strip to be threaded automatically into the roll stand without causing damage to at least one of the lateral surfaces of the working rolls 5, the roll stand 2 is activated in such a way that, before the metal strip 3 arrives in the rolling gap G, the working rolls 5 rotate at a circumferential speed Vu that is essentially equal to the inlet-side strip head speed Ve. In addition, the rolling gap G of the roll stand 2 is set by the control device 6 essentially such that the vertical opening of the rolling gap G corresponds essentially to the strip head thickness Dw of the head of the strip 4 running in. Therefore, before the metal strip 3 enters the rolling gap, but at the latest when the metal strip enters the rolling gap: $Dw \cong G$.

A rolling stock or metal strip enters the rolling gap of a roll stand when the head of the rolling stock or the head of the strip penetrates the plane defined by the longitudinal axes of the two working rolls of the roll stand.

Figure 2:
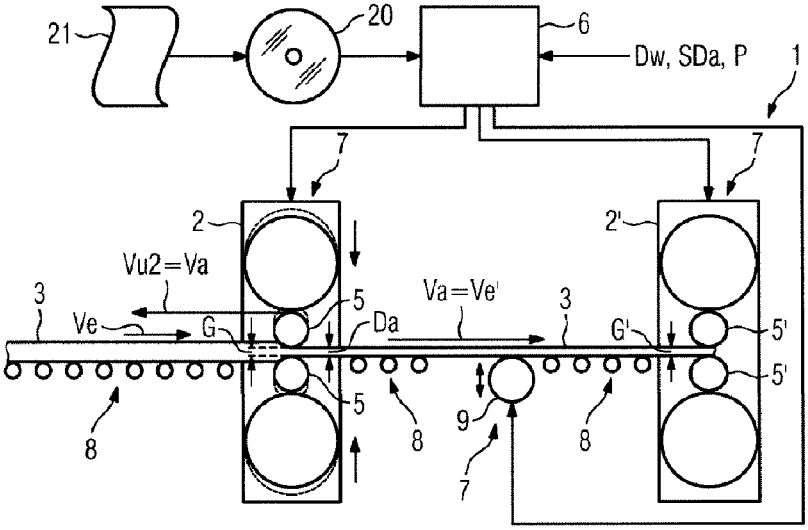
FIG. 2 shows a schematic view of a detail of a rolling mill with a strip that has been introduced into a roll stand.

FIG. 2 shows a schematically represented detail of a rolling mill 1 after a metal strip 3 has been threaded into the roll stand 2.

In FIG. 2, a rolling gap G of the roll stand 2 has been closed to a pre-calculated value, so that a desired outlet-side thickness Da of the metal strip 3 is set. The original arrangement of the working rolls 5 from FIG. 1 is indicated in FIG. 2 by dashed lines. FIG. 2 shows the rolling mill at a point in time clearly after completion of the threading-in operation at the roll stand 2.

When the metal strip 3 is threaded into the roll stand 2, the rolling gap G from FIG. 1 is preferably closed during or on, alternatively after, the arrival of the head of the strip 4 from FIG. 1. Essentially at the same time as the closing of the rolling gap G to a prescribed value, so that a desired outlet-side thickness SDa of the metal strip 3 is reached, the circumferential speed Vu2 of the working rolls 5 is changed to match the outlet-side strip speed Va of the metal strip 3 or to match the outlet-side strip thickness Da of the metal strip 3 or to match the current opening of the rolling gap G.

Essentially when the desired outlet-side thickness SDa of the metal strip 3 is reached, the circumferential speed Vu2 of the working rolls 5 is essentially equal to the outlet-side strip speed Va. The outlet-side strip speed Va for the roll stand 2 is likewise the outlet-side strip speed Ve' for the next roll stand 2', following downstream of the roll stand 2.

The circumferential speed Vu2 of the working rolls 5 after the threading into the roll stand 2 is generally of a higher level than the circumferential speed Vu2 of the working rolls shortly before the head of the strip 4 enters the rolling gap G from FIG. 1.

In any case, the circumferential speed of the working rolls after completion of the threading-in of the rolling stock at a roll stand in relation to the running-in speed of the metal strip then applicable is increased in comparison with the circumferential speed shortly before the head of the rolling stock enters the rolling gap in relation to the rolling stock head speed applicable at this point in time.

The introduction of the metal strip 3 into the roll stand 2' takes place analogously to the introduction of the metal strip 3 into the roll stand 2.

Such a threading-in method makes significantly lower losses in throughput and lower losses of metal strip 3 possible than in the case of conventional methods, and at the same time protects the working rolls 5 or 5' from being damaged by the metal strip 3 running in.

Figure 4:
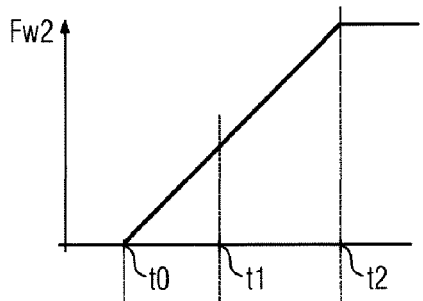
FIG. 4 shows a progression of the rolling force over time for a first roll stand when the rolling stock is threaded into the roll stand.
Figure 5:
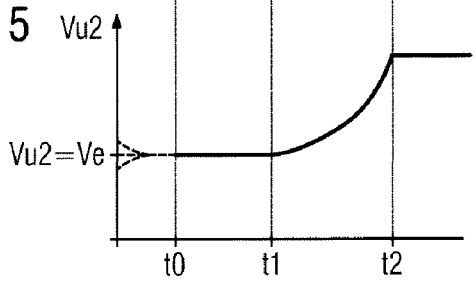
FIG. 5 shows a progression of the circumferential speed of the working rolls of the first roll stand associated with the progression of the rolling force that is represented in FIG. 4.

The increase in a rolling force Fw2 exerted on the metal strip 3 at the roll stand 2 when the metal strip 3 arrives at the rolling gap G of FIG. 1 is qualitatively represented in FIG. 4. The associated qualitative progression of the increase in the circumferential speed Vu2 of the working rolls 5 of the roll stand 2 that takes place essentially synchronously is represented in FIG. 5.

In FIG. 2, the operation of rolling the metal strip 3 has already progressed to the extent that the metal strip has also been threaded into a second roll stand 2', following downstream of the roll stand 2 as the next roll stand. As soon as the roll stand 2' acts as the driver on the metal strip 3, the strip tension control of the control device 6 is activated or enabled. By means of a measuring roller 9, the tensile stress of the metal strip 3 is recorded, preferably as from the point in time at which the roll stand 2' begins to act as a driver on the metal strip 3.

The entry of the metal strip 3 into the rolling gap G' of the roll stand 2' or the beginning of the thickness reduction of the metal strip 3 in the roll stand 2' may cause strip tension defects on the basis of the material flow conditions and activation of the roll stands 2, 2'. These are undesired and can be avoided or eliminated by a strip tension control.

The strip tension of the metal strip 3 may be set by means of suitable adjusting means 7. Adjusting means 7 may be the roll stands 2 or 2' themselves, with the circumferential speed of the working rolls 5 or 5' and/or the screw-down force being used as the manipulated variable for setting the strip tension. Additional adjusting means of any kind known to a person skilled in the art may also be used for setting the tensile stress of the metal strip 3, for example suitable rollers 9 that can be activated.

Strip tension control on the one hand allows a tensile stress defect to be eliminated after it occurs or on the other hand allows such a defect to be avoided from the outset, by pre-calculation. The pre-calculation is made possible for instance by using a rolling model. Such rolling models are known, for example, from the technical article with the title "Adaptive Rolling Model for a Cold Strip Tandem Mill" by Kurz et al., published by the AISE, Pittsburgh, in 2001. Many other sources of usable rolling models for the pre-calculation of a tension defect and for the pre-calculation of a desired outlet-side thickness SDa of a metal strip 3 are also available.

A tension defect that has already occurred and been recorded by the measuring roller 9 is eliminated by activating adjusting means 7 for influencing the tensile stress, such as for instance at least one roll stand 2 or 2', between the rolls of which the tension defect occurs, or other suitable adjusting means, for instance a loop lifter.

Figure 3:
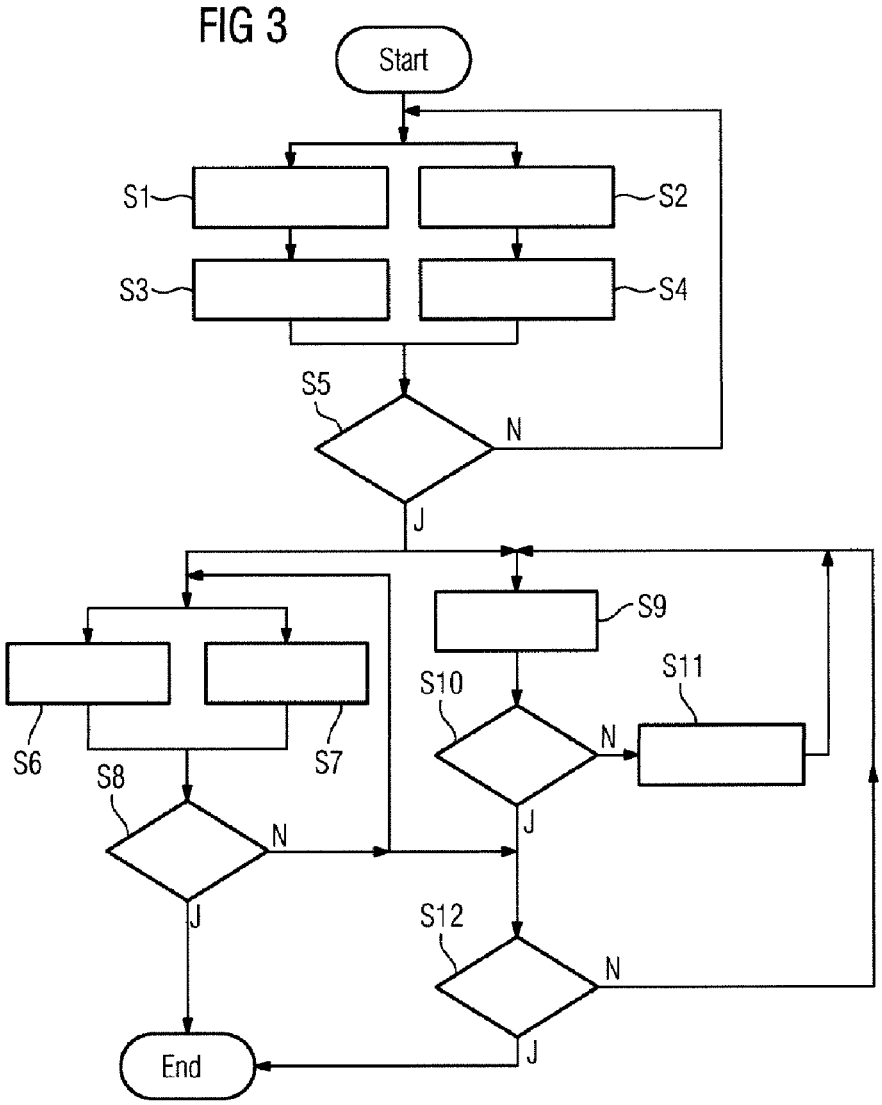
FIG. 3 shows a flow diagram to represent a sequence of the method according to various embodiments that is given by way of example.

A flow diagram shown in FIG. 3 shows an embodiment given by way of example for carrying out the method for introducing rolling stock into a roll stand of a rolling mill. The flow diagram presupposes that a metal strip runs to a first roll stand of a rolling mill and is intended to be threaded into the roll stand, the first roll stand being followed downstream by a second roll stand.

In a first method step S1, before the head of the strip enters the first roll stand, the strip head speed of the head of the metal strip is recorded and fed to the control device. The strip head speed may, for example, be recorded by information from driver rollers driving the metal strip or by measurement. By means of this information, the control device activates the working rolls in a method step S3 in such a way that they rotate at a circumferential speed which is essentially equal to the strip speed of the metal strip entering the rolling gap. Likewise before the head of the strip or the beginning of the strip enters the rolling gap of the first roll stand, in a method step S2, the strip head thickness of the head of the strip running to the first roll stand is recorded and fed to the control device. On the basis of the fed strip head thickness, the control device activates the roll stand in a method step S4 in such a way that the opening of the rolling gap in the vertical direction is essentially equal to the strip head thickness of the head of the strip running into the roll stand.

In a next method step S5, it is checked, for instance by strip head tracking, whether the head of the strip has already entered the rolling gap. If the head of the strip has not yet reached the rolling gap of the roll stand, it may be possible to run through a further loop, i.e. updating of the strip head speed and the strip head thickness, and activate the roll stand for correspondingly setting the circumferential speed and the rolling gap by the control device.

If the head of the strip has entered the rolling gap, a load is applied to the rolling gap in a method step S6, i.e. the rolling force acting on the metal strip is increased, for example from a force of zero. At first the rolling force is still so small that no decrease in thickness of the metal strip takes place. In this case, the roll stand acts as a driver. If the rolling force exceeds a threshold rolling force, a thickness reduction of the metal strip commences. Essentially with commencement of a thickness reduction of the metal strip, the circumferential speed of the working rolls is changed in dependence on the thickness reduction of the metal strip in a method step S7.

As long as the rolling gap has not yet been set to the value that has, for example, been prescribed by a rolling model—this is checked in a method step S8—the rolling force on the metal strip is further increased in the way provided by method step S6.

The increase in the circumferential speed takes place in such a way that the product of the strip thickness on the outlet side or the current rolling gap opening and the circumferential speed of the working roll at each point in time is essentially always the same constant. When the prescribed value of the rolling gap is reached, a desired circumferential speed of the working rolls is also reached and is then to be kept essentially constant. The reaching of the desired circumferential speed or the prescribed rolling gap value is established in the method step S8.

If during the threading-in operation there is an undesired deviation from the progression of the circumferential speed in relation to the progression of the rolling force, there is generally a defect in the tensile stress of the metal strip.

Any specifications can be made for the progression of the rolling force and the progression of the circumferential speed in the time phase in which the rolling gap is closed to the desired value. For example, it may be envisaged to increase the circumferential speed linearly, and consequently to provide a linear thickness reduction, which leads to a non-linear force-time progression. Alternatively, a linear force progression may be prescribed. This results in a non-linear thickness decrease with linearly increasing rolling force and, as a result, a non-linear, opposite increase in the circumferential speed.

Parallel in time with the changing of the rolling force and the circumferential speed during the threading-in, in a method step S9 the tensile stress of the metal strip is measured. A measuring roller is used, for example, for this.

In a method step S10, it is checked whether there is a deviation of the measured tensile stress from the desired tensile stress. If there is no deviation, it is checked in a next method step S12 whether the threading-in operation has been completed. The threading-in operation has been completed for the respective roll stand if the desired values for the rolling force or for the thickness of the rolling stock on the outlet side or for the prescribed value of the rolling gap and the circumferential speed of the working rolls are reached for the respective rolls stand. If it is established in method step S12 that the threading-in operation has not yet been completed, a renewed measurement of the tensile stress of the metal strip is carried out, with subsequent checking.

If it is established in method step S10 that the tensile stress deviates from the intended tensile stress for the metal strip, in a method step S11 the tensile stress of the metal strip is set again to the intended tensile stress by means of an adjusting means for influencing the tensile stress, which may for example be formed as a loop lifter and/or roll stand. This generally takes place in a number of steps. The tensile stress is controlled to the intended tensile stress by means of successive measurement of the tensile stress and comparison with the intended tensile stress. Alternatively, a pre-calculation may be used in order to avoid tensile defects completely, by corresponding activation of the adjusting means for influencing the tensile stress.

FIG. 4 and FIG. 5 respectively show the progression of the rolling force over time and a progression of the circumferential speed of the working rolls over time for a rolling stand 2 from FIG. 1 or FIG. 2 during the introduction of the metal strip into the roll stand.

Shortly before the point in time $t_0$, the head of the metal strip enters the rolling gap of the roll stand. The circumferential speed of the working rolls and the rolling gap have at this point in time already been set according to various embodiments, for instance from a higher or lower circumferential speed to the strip head speed.

The rolling gap is then closed by means of the control device and a linearly increasing rolling force Fw2 is exerted on the metal strip arranged between the working rolls. Up until the point in time t1, no thickness reduction of the metal strip takes place, i.e. the working rolls of the roll stand merely act as driver rollers. The working rolls therefore still run at a circumferential speed that is essentially the same as the strip head speed.

Figure 6:
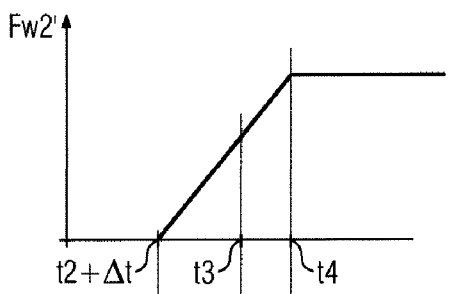
FIG. 6 shows a progression of the rolling force over time for a second roll stand, following directly downstream of the first roll stand, when the rolling stock is threaded into the roll stand.

As from the point in time t1, a thickness reduction of the metal strip commences, i.e. the opening of the rolling gap in the vertical direction is reduced. At the same time, the circumferential speed of the working rolls is increased. On the basis of the linear application of force to the metal strip, represented in FIG. 4, the thickness reduction takes place non-linearly. Accordingly, as shown in FIG. 6, the increase in the circumferential speed of the working rolls of the roll stand also takes place non-linearly.

The roll stand may also be made to operate conversely, i.e. the thickness reduction and the increase in circumferential speed take place linearly. Accordingly, a non-linear force is applied to the metal strip.

However, in both cases the circumferential speed of the working rolls is changed in dependence on the thickness of the rolling stock on the outlet side.

When the desired thickness of the metal strip running out from the roll stand is reached at the point in time t2 and is subsequently controlled to a constant value, a circumferential speed value that is made to match the desired thickness of the metal strip is essentially also achieved and then likewise kept essentially constant.

The progressions represented in FIG. 4 and FIG. 5 are idealized. Deviations from the qualitative progressions on account of tension defects, which for example cause a reduction in the running-in speed of the rolling stock into a first roll stand, are not taken into consideration here.

Figure 7:
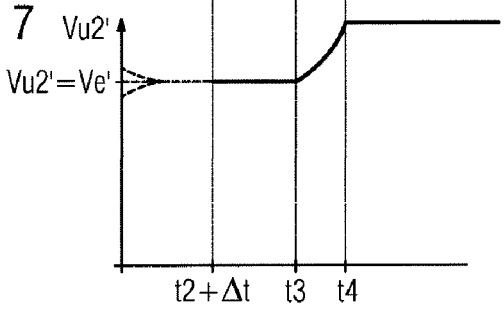
FIG. 7 shows a progression of the circumferential speed of the working rolls for the second roll stand associated with the progression of the rolling force that is represented in FIG. 6.

FIG. 6 and FIG. 7 analogously show respectively the progression of the rolling force over time and the progression of the circumferential speeds over time of the working rolls for the second roll stand 2' from FIG. 2. Here there is an analogous procedure for threading the metal strip into the roll stand 2 from FIG. 2, the metal strip having run at least partially through the first roll stand 2 from FIG. 1 or FIG. 2 when it is threaded into the roll stand 2'.

As from the point in time t2, at which the desired thickness of the metal strip is set in the roll stand 2, the metal strip generally continues to run for a time Δt until the working rolls of the roll stand 2' from FIG. 2 apply a force to the metal strip.

When the metal strip enters the rolling gap of the roll stand 2' from FIG. 2 shortly before the point in time t2+Δt, the rolling gap has been set to correspond to the strip head thickness of the metal strip running to the roll stand. The working rolls are rotated in such a way that they have a circumferential speed that is equal to the strip head speed of the metal strip running in. The operation of setting the circumferential speed of the working rolls to the strip head speed is represented in FIG. 5 and FIG. 6 by dashed lines for different starting circumferential speeds of the working rolls. The strip head speed of the metal strip is generally at a higher level upstream of the roll stand 2' from FIG. 2 than the strip head speed of the metal strip upstream of the roll stand 2 from FIG. 2.

When the head of the strip enters the rolling gap of the roll stand 2' from FIG. 2, the rolling gap is closed and, as from the point in time t2+Δt, a rolling force Fw2' that increases linearly over time is exerted on the metal strip. Up to a point in time t3, the rolling force Fw2' exerted on the metal strip does not lead to any essential material flow of the metal strip. Up to this point in time t3, the circumferential speed of the working rolls of the roll stand 2' from FIG. 2 is therefore equal to the strip head speed of the strip running in. As from the point in time t3, at which a plastic deformation of the metal strip commences, the circumferential speed of the working roll is changed in a way corresponding to the thickness of the metal strip on the outlet side. As soon as an essentially constant outlet-side strip thickness is reached, i.e. generally the desired thickness of the metal strip on the outlet side, the circumferential speed of the working rolls is also essentially constant. This happens at the point in time t4.

The effect that, at the beginning of the plastic deformation, the running-in speed of the strip into the roll stand is reduced, and as a result tensile stress defects occur, since the outlet-side strip speed of the preceding roll stand 2 from FIG. 2 is higher than the inlet-side strip speed into the roll stand 2' as soon as the plastic deformation begins has not been taken into consideration in the schematic diagrams. The elimination or avoidance of such tensile stress defects is achieved by a strip tension control, it being possible for this to have an effect, inter alia, on the circumferential speeds of the working rolls of the first and second roll stands 2 and 2' from FIG. 2.

What is claimed is:

1. An operating method for introducing a rolling stock to be threaded into a roll stand of a rolling mill wherein the rolling mill has a roll stand with working rolls and a control device, the method comprising:

moving a head of the rolling stock to be threaded toward the roll stand at a rolling stock head speed, wherein the working rolls form a rolling gap, before the head of the rolling stock to be threaded enters the rolling gap:

rotating the working rolls at a circumferential speed that is essentially equal to the speed of the head of the rolling stock, and setting the rolling gap in the vertical direction essentially to a thickness of the head of the rolling stock on the inlet side, and when or after the head of the rolling stock enters the rolling gap, closing the rolling gap to a predetermined value and, essentially at the same time as the closing of the rolling gap, changing the circumferential speed of the working rolls based on the rolling gap.

2. The operating method according to claim 1, wherein a tensile stress of the rolling stock is measured at least on one of the inlet side and outlet side at least one of upstream and downstream of the roll stand, and wherein the control device activates adjusting means for influencing the tensile stress of the rolling stock in such a way that an intended tensile stress of the rolling stock in dependence on the measured tensile stress.

3. The operating method according to claim 1, wherein the control device activates adjusting means for influencing a tensile stress of the rolling stock in such a way that a tensile stress intended for the rolling stock is maintained by means of manipulated variables pre-calculated by a rolling model.

4. A rolling mill for rolling a rolling stock comprising:

a roll stand with working rolls, and a control device comprising a computer-readable program code stored in a non-transitory computer-readable medium, the computer program code being executable by the control device to:

move a head of rolling stock to be threaded toward the roll stand at a rolling stock head speed, wherein the working rolls form a rolling gap, before the head of the rolling stock to be threaded enters the rolling gap:

rotate the working rolls at a circumferential speed that is essentially equal to the speed of the head of the rolling stock, and set the rolling gap in the vertical direction essentially to a thickness of the head of the rolling stock on the inlet side, and when or after the head of the rolling stock enters the rolling gap, close the rolling gap to a predetermined value and, essentially at the same time as the closing of the rolling gap, change the circumferential speed of the working rolls based on the rolling gap.

5. The rolling mill according to claim 4, comprising:

a measuring device configured to measure a tensile stress of the rolling stock on at least one of the inlet side and outlet side at least one of upstream and downstream of the roll stand, and adjusting means for influencing the tensile stress of the rolling stock being activated by the control device in such a way that an intended tensile stress of the rolling stock is set based on the measured tensile stress.

6. The rolling mill according to claim 4, comprising adjusting means for influencing a tension of the rolling stock, which adjusting means are controllable by the control device in such a way that a tensile stress intended for the rolling stock is maintained based on manipulated variables pre calculated by a rolling model.

7. The rolling mill according to claim 4, wherein the rolling stock is a metal strip.

8. The rolling mill according to claim 4, wherein changing the circumferential speed of the working rolls based on the rolling gap comprises increasing the circumferential speed of the working rolls.

9. The operating method according to claim 1, wherein the rolling stock is a metal strip.

10. The operating method according to claim 1, wherein changing the circumferential speed of the working rolls based on the rolling gap comprises increasing the circumferential speed of the working rolls.

* * * * *